US006848934B1

(12) United States Patent
McCarthy

(10) Patent No.: US 6,848,934 B1
(45) **Date of Patent: *Feb. 1, 2005**

(54) BATTERY TERMINAL

(75) Inventor: Dale C. McCarthy, Pensacola, FL (US)

(73) Assignee: Centerpin Technology, Inc., Pensacola, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/330,381

(22) Filed: Jun. 11, 1999

Related U.S. Application Data

(63) Continuation-in-part of application No. 08/999,356, filed on Dec. 29, 1997, now Pat. No. 5,934,943, which is a continuation-in-part of application No. 08/645,514, filed on May 14, 1996, now Pat. No. 5,704,814.

(51) Int. Cl.[7] ..... H01R 4/24
(52) U.S. Cl. ..... 439/427; 439/754
(58) Field of Search ..... 439/427–429, 439/754–774

(56) References Cited

U.S. PATENT DOCUMENTS

| | | | | |
|---|---|---|---|---|
| 916,313 A | | 3/1909 | Herrington | |
| 1,247,656 A | | 11/1917 | Gadke | |
| 1,258,304 A | | 3/1918 | Bishop | |
| 1,856,018 A | | 4/1932 | Barth | |
| 2,713,155 A | | 7/1955 | Anderson | |
| 2,765,451 A | | 10/1956 | Anderson | |
| 3,097,035 A | | 7/1963 | Despard | |
| 3,317,883 A | * | 5/1967 | Gourley et al. | 439/427 |
| 3,633,147 A | | 1/1972 | Polidori | |
| 3,860,320 A | | 1/1975 | Danner | |
| 4,013,333 A | | 3/1977 | Chang | |
| 4,091,233 A | | 5/1978 | Berman | |
| 4,270,827 A | | 6/1981 | Potgieter | |
| 4,374,458 A | | 2/1983 | Komada | |
| 4,786,760 A | | 11/1988 | Friedhelm | |
| 5,403,201 A | | 4/1995 | McCarthy | |
| 5,573,423 A | | 11/1996 | Lin et al. | |
| 5,704,814 A | | 1/1998 | McCarthy | |
| 5,775,934 A | | 7/1998 | McCarthy | |
| 5,934,937 A | * | 8/1999 | McCarthy | 439/583 |

FOREIGN PATENT DOCUMENTS

| | | | |
|---|---|---|---|
| GB | 0460156 | * | 1/1937 |

* cited by examiner

*Primary Examiner*—Khiem Nguyen
(74) *Attorney, Agent, or Firm*—Daspin & Aument, LLP; Jefferson Perkins

(57) ABSTRACT

A connector is provided for coupling a single wire electrical cable to an electrical appliance. The connector includes a body portion, a compression collar, and an end cap. The body portion has an elongated axis at one end of which is a battery terminal attaching portion and at the other end of which is a cable receiving portion that has a threaded outer surface and an internally positioned electrically conducive prong for penetrating the end of an electrical cable. The compression collar is sized to fit over an electrical conductor and has gripping fingers for engaging the surface of an electrical conductor. The end cap has an opening through which a cable can be inserted and includes threads on the inner surface for mating with the threads on the body portion. In practice, an electrical conductor is inserted through the opening in the end cap and through the compression collar and impinged onto the conductive prong of the body portion. Then the end cap is threaded onto the body portion, engaging the compression collar and forcing the gripping fingers of the compression collar into engagement with the surface of the electrical conductor and thereby forcing the electrical conductor into tight engagement with the conducive prong of the connector. One embodiment provides for a cap having the gripping collar positioned and held in the cap by flanges loosely mated to the cap at each end of the collar thereby to allow the cap to rotate independently of the collar.

24 Claims, 2 Drawing Sheets

BATTERY TERMINAL

This application is a continuation-in-part (CIP) of prior application No. 08/999,356, filed Dec. 29, 1997, now U.S. Pat. No. 5,934,943, which is a continuation-in-part of application Ser. No. 08,645,514, filed May 14, 1996, now U.S. Pat. No. 5,704,814.

BACKGROUND OF THE INVENTION

The present invention relates to electrical connectors and especially to an electrical connector for coupling a single wire insulated electrical conductor to an electrical appliance. This application is a continuation-in-part of my previous patent application for Electrical Connector filed Dec. 29, 1997, Ser. No. 08/999,356 which is a continuation in part of previous patent application for Electrical Connector filed May 14, 1996, Ser. No. 08/645,514, now U.S. Pat. No. 5,704,814, dated Jan. 6, 1998.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder. A wide variety of connectors have been provided which removably hold the wire to the connector.

Typical electrical connectors are used in audio systems, such as in hi-fi speakers in which a wire end is stripped of the insulation and is inserted into an opening and then a threaded nut is used to removably attach the wire. Other connectors use spring clamps which allows a wire end stripped of insulation to be inserted into a connector opening with the spring clamp open and then releasing the spring clamp onto the wire. Reopening of the spring connector clamp allows the removal of the wire end. Other commonly used connectors allow a stripped wire end to be inserted into a conductive sleeve which is then clamped with pliers to collapse a conductive sleeve onto the wire. Automobile batteries are commonly connected to the automotive electrical circuitry with battery terminal connectors which are fixedly attached to battery cables and mechanically clamped onto the battery terminal posts.

Prior battery cable connectors can be seen in the following U.S. Patents. The Potgieter U.S. Pat. No. 4,270,827 is for a battery cable connector for batteries commonly used in motor vehicles having terminals in the form of cylindrical posts, which connector includes a conical element which penetrates the insulated wires of the battery cable end to spread the wires out on all sides along a surface. In U.S. Pat. No. 1,856,018 an electrical connector and terminal is shown which uses a conical wedge member to lock the battery cable to the connector. In the Anderson U.S. Pat. Nos. 2,765,451 and 2,713,155, a battery clamp uses a triangular tongue which is driven into the end of the battery cable. U.S. Pat. No. 1,258,304 is for a cable terminal which has a metal end collar attached over the end of a battery cable which is inserted against a piercing prong to make conductive contact. U.S. Pat. No. 1,247,656 to Gadke is a terminal for conductors which has a cylindrical sleeve which fits over the end of an insulated conductor and a conical tip.

Prior U.S. patents which show electrical connectors which used conductive prongs and which are not used for battery terminal connectors may be seen in the Chang U.S. Pat. No. 4,013,333 for a wire connector having two concentric sockets adapted to be assembled one into the other and in which the inner socket has a conductive needle mounted therein for sliding a wire end into each end of the connector and which uses a spike pressed into holes in the sleeves to penetrate the coating of the wire ends. In the Danner U.S. Pat. No. 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. patent to Friedhelm, No. 4,786,760, a cable connector for a piezoelectric cable has an insulated cable end which is inserted into a sleeve. In the U.S. patent to Berman, No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201, an electrical connector is coupled to an insulated electrical conductor without stripping the end of the insulated conductor. The insulated wire is held with a spring clamp which allows the wire to be released.

The Komada U.S. Pat. No. 4,374,458 is for a method of connecting a co-axial cable to a connector having a plurality of connections. The Herrington U.S. Patent No. 916,313 is for a spark plug having a spark plug wire connector on the end thereof. The Despard U.S. Pat. No. 3,097,035 is for another electric cable connector for use between sections of flexible multi-conductor cable as used with portable electric power consuming equipment and to a fixed power outlet. The Polidori U.S. Pat. No. 3,633,147 has a connector for underground utility applications.

SUMMARY OF THE INVENTION

An electrical connector is provided for coupling a single wire electrical cable to the terminal of an electrical appliance. The connector includes a body portion, a compression collar, and an end cap. The body portion has an elongated axis at one end of which is a battery terminal attaching portion and at the other end of which is a cable receiving portion that has a threaded outer surface and an internally positioned electrically conducive prong for penetrating the end of an electrical cable. The compression collar is sized to fit over an electrical conductor and has gripping fingers for engaging the surface of an electrical conductor. The end cap has an opening through which a cable can be inserted and includes threads on the inner surface for mating with the threads on the body portion. In practice, an electrical conductor is inserted through the opening in the end cap and through the compression collar and impinged onto the conductive prong of the body portion. Then the end cap is threaded onto the body portion, engaging the compression collar and forcing the gripping fingers of the compression collar into engagement with the surface of the electrical conductor and thereby forcing the electrical conductor into tight engagement with the conducive prong of the connector.

BRIEF DESCRIPTION OF THE DRAWINGS

The objects, features, and advantages of the present invention will be apparent from the following written description, the claims, and the drawings in which:

DESCRIPTION OF THE PREFERRED EMBODIMENTS

Figures 1, 2:
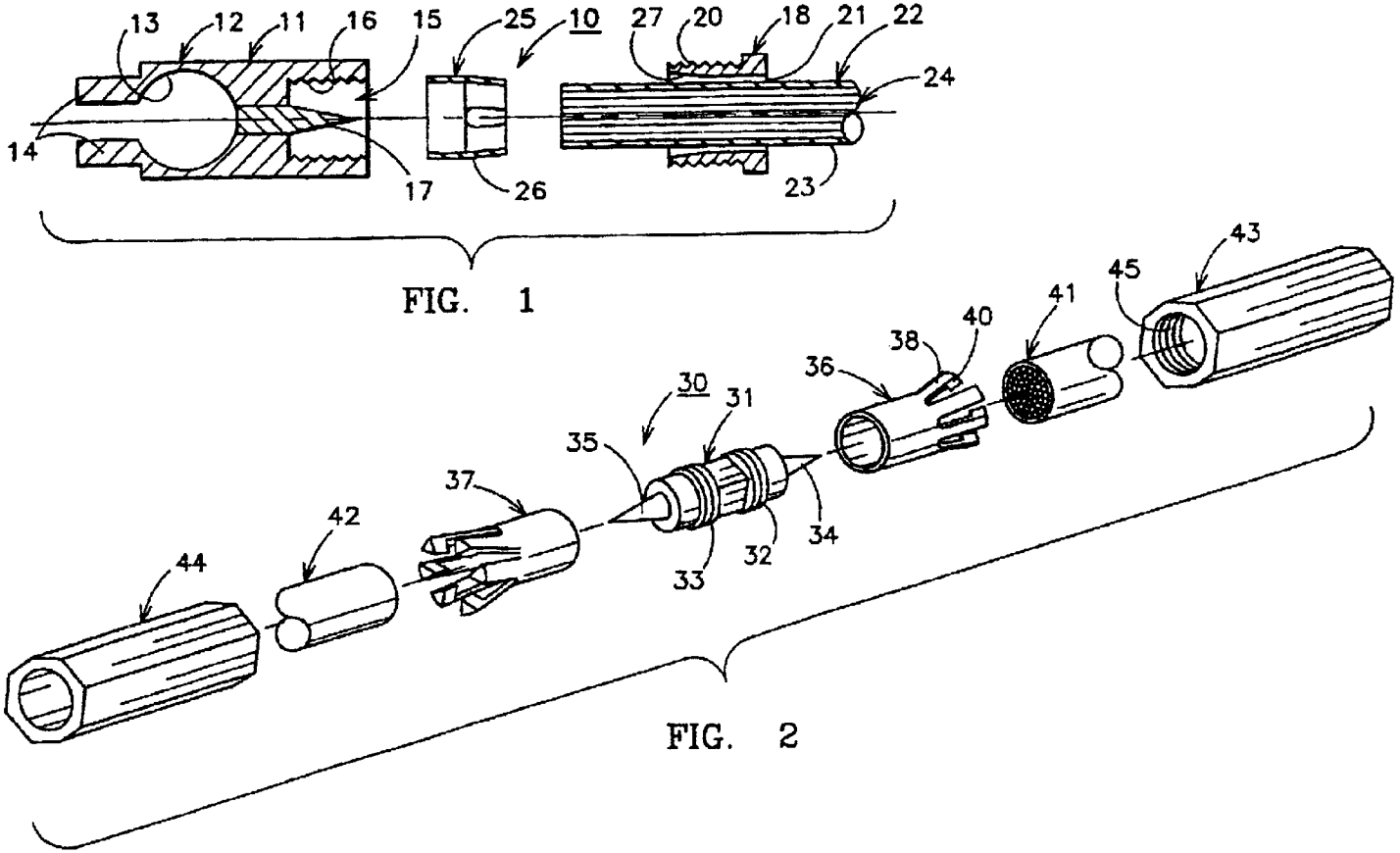
FIG. 1 is an exploded sectional view of a battery terminal in accordance with the present invention.
FIG. 2 is an exploded perspective view of a second embodiment of the battery terminal of the present invention.

Referring to FIG. 1 of the drawings, an electrical connector 10 is illustrated having a connector body 11 with a battery terminal connecting portion 12 with an opening 13 which slips over the post of a battery terminal and allows the connector arm portions 14 to be pressed together to attach the body 11 to a battery terminal post. The terminal connector body 11 is generally made of an electrically conductive material, such as lead, and the body 11 has a bore 15 with internal threads 16 and a conductive prong 17 attached to or integral with the body 11 and extending axially into the bore 15. The terminal connector of FIG. 1 has a locking end cap 1B with external threads 20 and having an opening 21 sized to receive a battery cable 22 therethrough. The cable 22 may be without or with an insulated cover 23 over an electrical cable conductor 24, as illustrated. A compression collar 25 has a plurality of tapered gripping fingers 26 and is sized to permit the cable 22 to pass therethrough.

In operation, the cable 22 is inserted through the cap 18, through the gripping collar 25, and into the bore 15 where it is driven upon the electrical conductive prongs 17. The cap 18 has a tapered internal surface 27 which drives against the tapered gripping fingers 26 of the compression collar 25 as the cap 18 is threaded onto the threads 16 of the body 11. This connector makes for a rapid connection of a battery cable to a battery terminal connector and allows for the rapid exchange of the terminal connector should the terminal connector become corroded.

Turning to FIG. 2, a cable connector 30 is illustrated for connecting two cables together end-to-end and includes a center cable body 31 having external threads 32 and 33 thereon and an electrically conductive prong 34 on one end and an electrically conductive prong 35 on the other end thereof. A pair of gripping collars 36 and 37 each has a plurality of gripping fingers 38 having pointed tips 40 for driving into the insulation on a piece of cable 41 or 42 placed through the gripping terminals 36 and 37. The cutting edges 40 will cut through the insulation on the cables 41 and 42 to grip the electrical conductor inside the insulation as well as hold the cable to the central body portion 31. Locking caps 43 and 44 each have internal threads 45 which can be slid over the cable 41 and 42. Cable 41 can be passed through the gripping collar 36 and pushed against the conductive prong 34 to make for an electrically conductive connection. The fingers 38 can then be compressed to compress the cutting edges 40 into the cable 41. The cap 43 has its threads 45 attached to the threads 32 to lock one end of the cable 41 to the connector body 31. Similarly, the cable 42 is passed through the locking cap 44, through the gripping collar 37 and driven onto the electrical conductive prong 35. The collar 37 can then be clamped onto the cable 42 and the cap 44 threadedly attached to the body 31 to connect two electrical conductive cables together.

Figure 3:
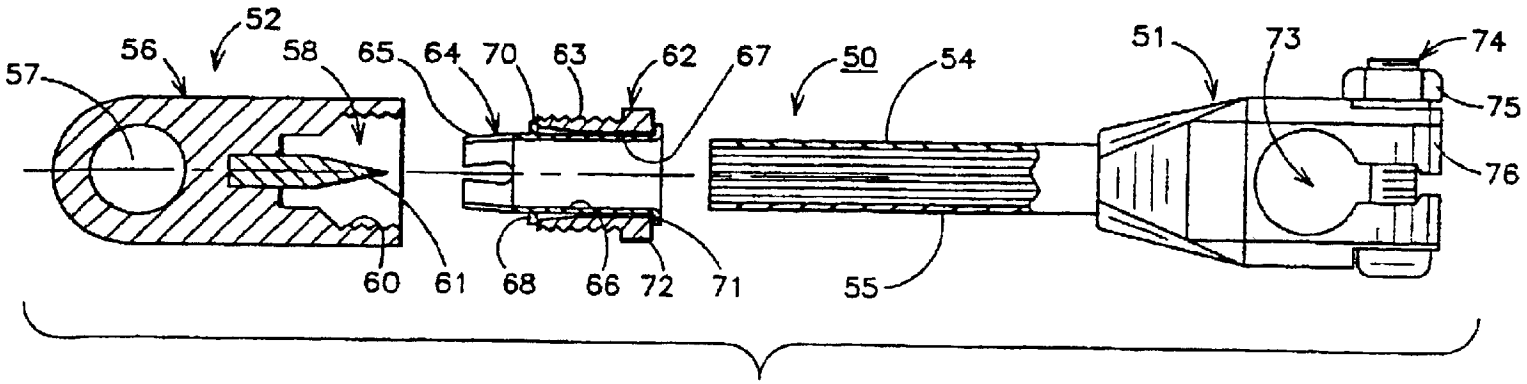
FIG. 3 is an exploded sectional view of a battery cable having battery terminal connectors attached thereto in accordance with the present invention.

Turning to FIG. 3, a battery cable 50 has terminals on both ends. The terminal connector 51 at the one end of the cable 50 is for attaching to a battery terminal post and the electrical connector 52 on the other end of the cable 50 is used for attaching grounding cable to the automotive chassis or to an electrical conductor in the electrical system of a car. The battery cable 50 has an insulation 54 and an electrical conductor 55 therein. The electrical connector 52 may be made of an electrical conductive material having a body 56 with an aperture 57 therethrough for attaching to the chassis of an automobile or the like. An internal bore 58 has internal threads 60 therein and an electrically conductive prong 61 protruding axially into the bore 58. A cable locking cap 62 has external threads 63 which mate with the internal threads 60 of the body portion 56. A gripping collar 64 has a plurality of angled gripping fingers 65 and has a generally cylindrical body 66 extending through the bore 67 and passing through the cap 62. A flanged area 68 holds the gripping collar 64 along one end 70 of the cap 62 while a flared flange 71 extends over the edge 72 of the cap 62. Holding the gripping collar 64 to the cap 62 in this manner allows the gripping collar to rotate within the cap 62 within the bore 67. This in turn allows the cable 53, once attached, to have a small amount of rotational movement to prevent undue stresses from building up on the connection to the terminal portion 56. The cable 53 is inserted through the gripping collar 64 in cap 62 and is impaled on the prong 61. The cap 62 is then threadedly connected with the body 56. The battery terminal connector 51 has a battery terminal opening 73 and has a bolt 74 and a nut 75 for drawing the arms 76 together in the same manner as a conventional battery terminal.

Figure 4:
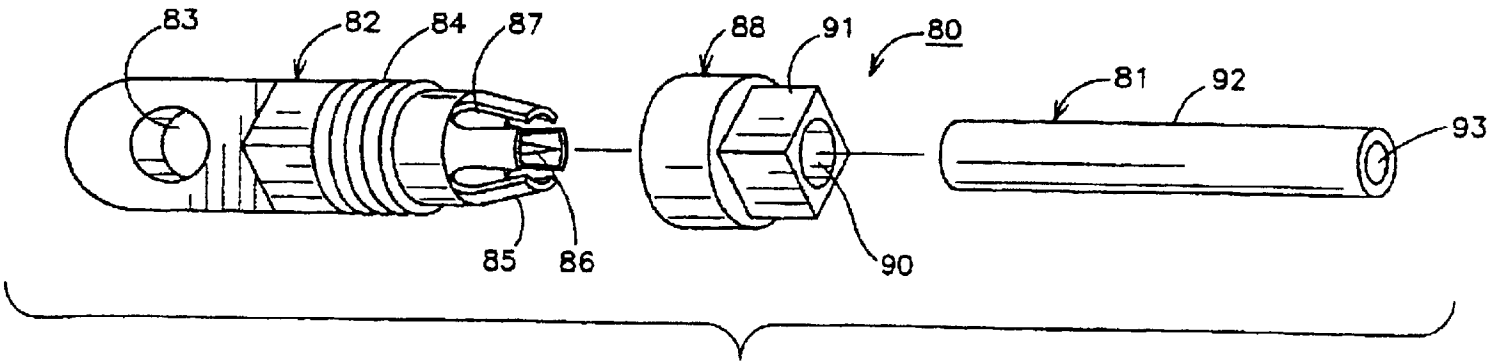
FIG. 4 is an exploded perspective view of another embodiment of the battery terminal of the present invention.

Turning to FIG. 4, a cable connector 80 for connecting to the end of an electrically conductive cable 81 includes a connector body 82 having an attaching aperture 83 and external threads 84. The body 82 also includes a plurality of gripping fingers 85 attached thereto and extending from one end thereof which defines a cylindrical cavity 87 surrounding an electrically conductive prong 86 extends therefrom into a bore 87. A locking cap 88 has internal threads which mate with the threads 84 and has a bore 90 extending therethrough. The cap 88 also has a wrench gripping surface 91 thereon.

In operation, the cable 81 is passed through the bore 90 within the cap 88 and pass through the gripping fingers 85 and into the cylindrical cavity 87 where it is impaled on the conductive prong 86. Tightening the cap 88 onto the threads 84 of the body 82 then compresses the fingers 85 onto the cable 81 passing therethrough to grip the cable 81 and hold it to the terminal body 82 while providing an electrical contact between the prong 86 and the cable 81. The cable 81 may have outer insulation 92 with an internal electrically conductive cable 93 or can be bare cable 93 as desired.

It should be clear at this time that an electrical connector has been provided which is especially adapted for attaching a battery cable to a battery cable terminal connector and which advantageously allows the cable to be connected and disconnected for replacement thereof as desired and which allows for the rapid assemble of a battery cable to any length desired without having to premake the cables in a wide variety of lengths. It should, however, also be clear that the present invention is not to be considered limited to the forms shown which are to be considered illustrative rather than restrictive.

I claim:

1. A battery cable connector comprising:

a body having threads formed thereon and having an electrically conductive prong attached thereto along an elongated axis of said body and extending therefrom for piercing the end of an electrical cable;

a cap having threads thereon removably attached to said body threads and having an opening therethrough, said cap being aligned with said body electrically conductive prong when said cap is attached to said body; and a compression collar sized to fit over said electrically conductive prong and over an electrical conductor passing through said cap, said compression collar having a conductor gripping means for gripping and holding a conductor onto said body when said cap is attached to said body over said collar, whereby an electrical cable can be secured to said battery cable connector.

2. A battery cable connector for coupling to one end of an electrical cable in accordance with claim 1 in which said compression collar has a plurality of fingers extending from the end thereof compressible onto an electrical conductor passing therethrough.

3. A battery cable connector in accordance with claim 2 in which each of said collar plurality of fingers has an insulation penetrating point on the end thereof positioned to penetrate into the insulation on an insulated electrical cable passing therethrough.

4. A battery cable connector in accordance with claim 3 in which said collar is fixedly attached to said body and extends over said prong extending from said body.

5. A battery cable connector in accordance with claim 3 in which said collar is fixedly attached to said cap for compression onto an insulated conductor extending therethrough.

6. A battery cable connector in accordance with claim 3 in which said body had a bore extending thereinto and said prong extends from said body into said bore along the center axis of said bore.

7. A battery cable connector in accordance with claim 1 in which said body has a pair of prongs thereon, one extending in a generally opposite direction from the other said prong.

8. A battery cable connector in accordance with claim 7 in which said body has two sets of threads and two threaded caps, one for threadedly attaching to each set of body threads on each end of said body over one of said pair of prongs.

9. A battery cable connector in accordance with claim 3 in which said collar is shaped to fit over the end of an insulated electrical conductor and be compressed thereon.

10. A battery cable connector in accordance with claim 1 in which said compression collar is rotatably mounted to said cap.

11. An electrical connector for coupling to an electrical conductor thereto comprising:

a body having an electrically conductive prong attached thereto along an elongated axis of said body and extending therefrom for piercing the end of an electrical conductor being attached thereto; and a body cap removably attachable to said body and having an opening therethrough, said body cap having a compression collar rotatably mounted through said body cap opening and sized to fit over an electrical conductor passing therethrough, said compression collar having a conductor gripping means for gripping and holding a conductor thereto and onto said body when said cap is attached to said body, whereby an electrical conductor can be inserted through said body cap and compression collar and onto said electrically conductive prong and said body cap and collar attached to said body to form an electrically conductive connection to said electrical connector.

12. An electrical connector for coupling to an electrical conductor thereto in accordance with claim 11 in which said compression collar has a flared end portion to hold said compression collar in said body cap from one end thereof.

13. An electrical connector for coupling to an electrical conductor thereto in accordance with claim 12 in which said compression collar has a flange therearound along the center portion thereof to hold said compression collar in said body cap from the other end thereof.

14. An electrical connector for coupling to an electrical conductor, comprising:

a body;

an electrically conductive prong attached to said body;

a rotatable gripping collar having a plurality of gripping fingers; and a body cap attachable to the body, wherein, an end of an electrical conductor can be passed through the body cap and through the gripping collar and driven onto the electrically conductive prong such as to make electrical contact between the electrical conductor and the electrically conductive prong, wherein said plurality of gripping fingers can be clamped onto the electrical conductor and the body cap attached to the body such that the body cap secures the gripping collar to the body and the electrical conductor to the prong while the gripping collar is able to rotate with the conductor and relative to, and within, the body cap.

15. The electrical connector according to claim 14, wherein said body cap is threadedly attachable to the body.

16. The electrical connector according to claim 14, further comprising:

a second electrically conductive prong attached to the body and in electrical contact with said electrically conductive prong;

a second gripping collar having a second plurality of gripping fingers; and a second body cap attachable to the body, wherein an end of a second electrical conductor can be passed through the second body cap and through the second gripping collar and driven onto the second electrically conductive prong such as to make electrical contact between the second electrical conductor and the second electrically conductive prong and electrical contact between the electrical conductor and the second electrical conductor, wherein said second plurality of gripping fingers can be clamped onto the second electrical conductor and the second body cap attached to the body such that the second body cap secures the second gripping collar to the body and the second electrical conductor to the electrical connector.

17. The electrical connector according to claim 14, wherein said gripping collar and said body are separate.

18. The electrical connector according to claim 14, wherein said plurality of gripping fingers are splayed prior to being clamped onto the electrical conductor, to allow the electrical conductor to pass through the gripping collar.

19. The electrical connector according to claim 18, wherein at least one of said plurality of gripping fingers has inwardly extending edges on the ends thereof for engaging the electrical conductor as the gripping fingers are clamped onto the electrical conductor.

20. The electrical connector according to claim 14, wherein when said plurality of gripping fingers are clamped onto the electrical conductor and the body cap attached to the body such that the body cap secures the gripping collar to the body and the electrical conductor to the electrical connector, the electrical conductor is forced into tight engagement with the conductive prong.

21. The electrical connector according to claim 14, wherein at least one of said plurality of gripping fingers comprises a pointed tip, wherein when said plurality of gripping fingers are clamped onto an electrical conductor having an outer layer of insulation and the body cap attached to the body such that the body cap secures the gripping collar to the body and the electrical conductor having an outer layer of insulation to the electrical connector, the pointed tip pierces the outer layer of insulation.

22. The electrical connector according to claim 14, wherein the body further comprises a battery terminal connecting portion.

23. An electrical connector for coupling to an electrical conductor, comprising:

a body;

an electrically conductive prong;

a gripping collar having a plurality of gripping fingers, and a body cap attachable to the body, wherein, an end of an electrical conductor can be passed through the body cap and through the gripping collar and driven onto the electrically conductive prong such as to make electrical contact between the electrical conductor and the electrically conductive prong wherein said plurality of gripping fingers can be clamped onto the electrical conductor and the body cap attached to the body such that the body cap secures the gripping collar to the body and the electrical conductor to the prong, wherein said gripping collar is integrally formed with said body.

24. The electrical connector according to claim 14, wherein said plurality of gripping fingers are clamped onto the electrical conductor as the body cap is attached to the body.

* * * * *